US008261570B2

(12) United States Patent
Shinohara et al.

(10) Patent No.: US 8,261,570 B2
(45) Date of Patent: Sep. 11, 2012

(54) ICE SUPPLYING APPARATUS AND REFRIGERATOR HAVING THE SAME

(75) Inventors: Katsutoshi Shinohara, Shimotsuke (JP); Kenji Shiono, Ota (JP); Shintaro Yamawaki, Koshigaya (JP); Taichiro Yamashita, Mito (JP); Yasuo Kurihara, Nishikata (JP)

(73) Assignee: Hitachi Appliances, Inc., Tokyo (JP)

( * ) Notice: Subject to any disclaimer, the term of this patent is extended or adjusted under 35 U.S.C. 154(b) by 834 days.

(21) Appl. No.: 12/372,800

(22) Filed: Feb. 18, 2009

(65) Prior Publication Data

US 2009/0293529 A1 Dec. 3, 2009

(30) Foreign Application Priority Data

May 30, 2008 (JP) ..... 2008-141837

(51) Int. Cl.
*F25C 5/18* (2006.01)

(52) U.S. Cl. ..... 62/344; 62/440

(58) Field of Classification Search ..... 62/344, 62/440, 441, 449, 137; 222/146.6
See application file for complete search history.

(56) References Cited

U.S. PATENT DOCUMENTS

| | | | | |
|---|---|---|---|---|
| 3,789,620 | A * | 2/1974 | Benasutti et al. | 62/344 |
| 4,090,641 | A * | 5/1978 | Lindenschmidt | 222/504 |
| 4,846,381 | A | 7/1989 | Kito et al. | |
| 5,077,985 | A * | 1/1992 | Buchser et al. | 62/344 |
| 5,359,795 | A * | 11/1994 | Mawby et al. | 40/405 |
| 6,425,259 | B2 | 7/2002 | Nelson et al. | |
| 7,111,473 | B2 | 9/2006 | Chung et al. | |
| 7,337,617 | B2 * | 3/2008 | Anderson | 62/66 |
| 7,418,831 | B2 * | 9/2008 | Bowen et al. | 62/344 |
| 7,797,961 | B2 | 9/2010 | An et al. | |
| 2001/0025505 | A1 * | 10/2001 | Nelson et al. | 62/371 |
| 2006/0090496 | A1 * | 5/2006 | Adamski et al. | 62/344 |
| 2006/0213213 | A1 * | 9/2006 | Chung et al. | 62/344 |

FOREIGN PATENT DOCUMENTS

| | | |
|---|---|---|
| CN | 1576760 | 2/2005 |
| JP | 2005-315571 | 11/2005 |
| KR | 2007 0079735 | 8/2007 |

OTHER PUBLICATIONS

CN Office Action of Application No. 2009 10008004.3.
Korean Appln. No. 10-2008-137103 with attached English translation.

* cited by examiner

*Primary Examiner* — Mohammad Ali
(74) *Attorney, Agent, or Firm* — Antonelli, Terry, Stout & Kraus, LLP.

(57) ABSTRACT

An ice supplying apparatus 100, being provided in a refrigerator 1, comprises: an ice maker unit 22, which is configured to supply ice pieces produced therein to an outside of a freezer room door; an ice storage unit 110, which is configured to store the ice pieces produced by the ice maker unit; an ice discharger unit 112, which is provided within the ice storage unit to discharge the ice pieces below; and a shrinking portion 111, which is provided in the ice storage unit and defines an interior space thereof as small as it goes down, through building up a lower surface 113, among interior surfaces defining that interior space 301 of the ice storage unit 110, for supporting the ice pieces stored therein from a lower potion thereof, by a surface inclining to a horizontal direction, wherein the ice discharger unit 112 is disposed in a lower portion of the shrinking portion 111.

11 Claims, 11 Drawing Sheets

ICE SUPPLYING APPARATUS AND REFRIGERATOR HAVING THE SAME

BACKGROUND OF THE INVENTION

The present invention relates to an ice supplying apparatus to be provided for enabling to supply ice pieces, which are produced by an ice making assembly provided within a freezer chamber, outside a freezer door, and it also relates to a refrigerator having the same ice supplying apparatus therein.

Conventionally is already known a refrigerator, enabling to supply ice pieces, which are produced by an ice making assembly provided within a freezer chamber, outside the freezer door being. Such the refrigerator is provided with an ice supplying apparatus having an ice storage portion or bin for storing therein the ice pieces, which are produced by the ice maker, and in that ice storage bin is provided an ice dispenser assembly for dispensing the ice pieces downwards. The refrigerator of kind is disclosed, for example, the following Patent Documents.

Within the ice supplying apparatus shown in the Patent Document 1, the ice pieces stored in the ice storage bin are transferred horizontally towards the freezer door in the mode of being pushed out in the horizontal direction by a transfer member.

However, with this ice supplying apparatus, since it transfers the ice pieces, horizontally, by means of the transfer member, there is a drawback that it is not always possible to apply a force, preferably, for the purpose of pushing out the ice pieces, depending on the position of the ice pieces.

For dissolving such the drawback, with the ice supplying apparatus disclosed in the Patent Document 2, an ice discharger portion (i.e., an ice outlet opening) is provide on a bottom surface of the ice storage bin for storing the ice pieces therein, so that the ice pieces can be supplied or dispensed in such a manner of falling downwards from that discharger portion.

[Patent Document 1] Japanese Patent Laying-Open No. 2005-315571 (2005); and

[Patent Document 2] U.S. Pat. No. 6,425,259 (2002), Nelson et al.

BRIEF SUMMARY OF THE INVENTION

However, with the ice supplying apparatus disclosed in the Patent Document 2 mentioned above, since a flat or horizontal portion is provided in part of the bottom surface of the ice storage bin, and since in that flat portion is provided the ice discharger portion (i.e., the ice outlet opening) for discharging the ice pieces, it is possible to discharge the ice pieces from the ice discharger portion when a large amount of the ice pieces is stored within the ice storage bin, however when the ice pieces come to small in the amount thereof, then there occurs such a phenomenon that ice pieces cannot be discharged. For example, in case where the flat portion mentioned above lies between the ice discharger portion and the ice pieces, it is impossible to discharge the ice pieces as far as functioning an external force to move the ice pieces to the ice discharger portion.

With the ice supplying apparatus disclosed in the Patent Document 2, by taking such the problem into the consideration thereof, an auger or stirrer is provided, rotating around an axis along the vertical direction, so that the ice pieces are guided into the discharger portion (i.e., the ice outlet opening). However, even with provision of such the auger, there is a possibility that, on the contrary, this auger staves off the ice pieces from the discharger portion (or, pushes away from the rotation area thereof), and in such case, it is more difficult to discharge the ice pieces therefrom.

In such manner, if it is impossible to discharge the ice pieces stored within the ice storage portion, preferably, then the ice pieces remain in the ice storage portion for a long time; therefore, it can be considered that the ice pieces comes to be aged, and/or that the ice pieces melt and fasten with each other, into a lump of ice, so that they cannot be discharged easily.

Then, according to the present invention, an object thereof is to provide an ice supplying apparatus for enabling to discharge the ice pieces stored within the ice storage portion, without remaining therein, preferably, from the ice discharger portion, and also a refrigerator having such the ice supplying apparatus therein.

The present invention is accomplished with aiming such object of dissolving the problems mentioned above.

Thus, for accomplishing the object mentioned above, according to the present invention, there is provided an ice supplying apparatus, being provided in a refrigerator, comprising: an ice maker unit, which is configured to supply ice pieces produced therein to an outside of a freezer room door; an ice storage unit, which is configured to store the ice pieces produced by said ice maker unit; an ice discharger unit, which is provided within said ice storage unit to discharge the ice pieces below; and a shrinking portion, which is provided in said ice storage unit and defines an interior space thereof as small as it goes down, through building up a lower surface, among interior surfaces defining that interior space of said ice storage unit, for supporting the ice pieces stored therein from a lower potion thereof, by a surface inclining to a horizontal direction, wherein said ice discharger unit is disposed in a lower portion of said shrinking portion.

According to the present invention, it is possible to discharge the ice pieces stored in the ice storage unit from the ice discharger unit, preferably, i.e., without remaining.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein:

FIG. 11A shows the path when supplying the ice pieces without crushing thereof, while FIG. 11B shows the path when supplying them with crushing thereof.

DETAILED DESCRIPTION OF THE PREFERRED EMBODIMENTS

Hereinafter, explanation will be given on an ice supplying assembly or apparatus according to an embodiment of the present invention, and a refrigerator equipped with that ice supplying assembly or apparatus.

Figure 1:
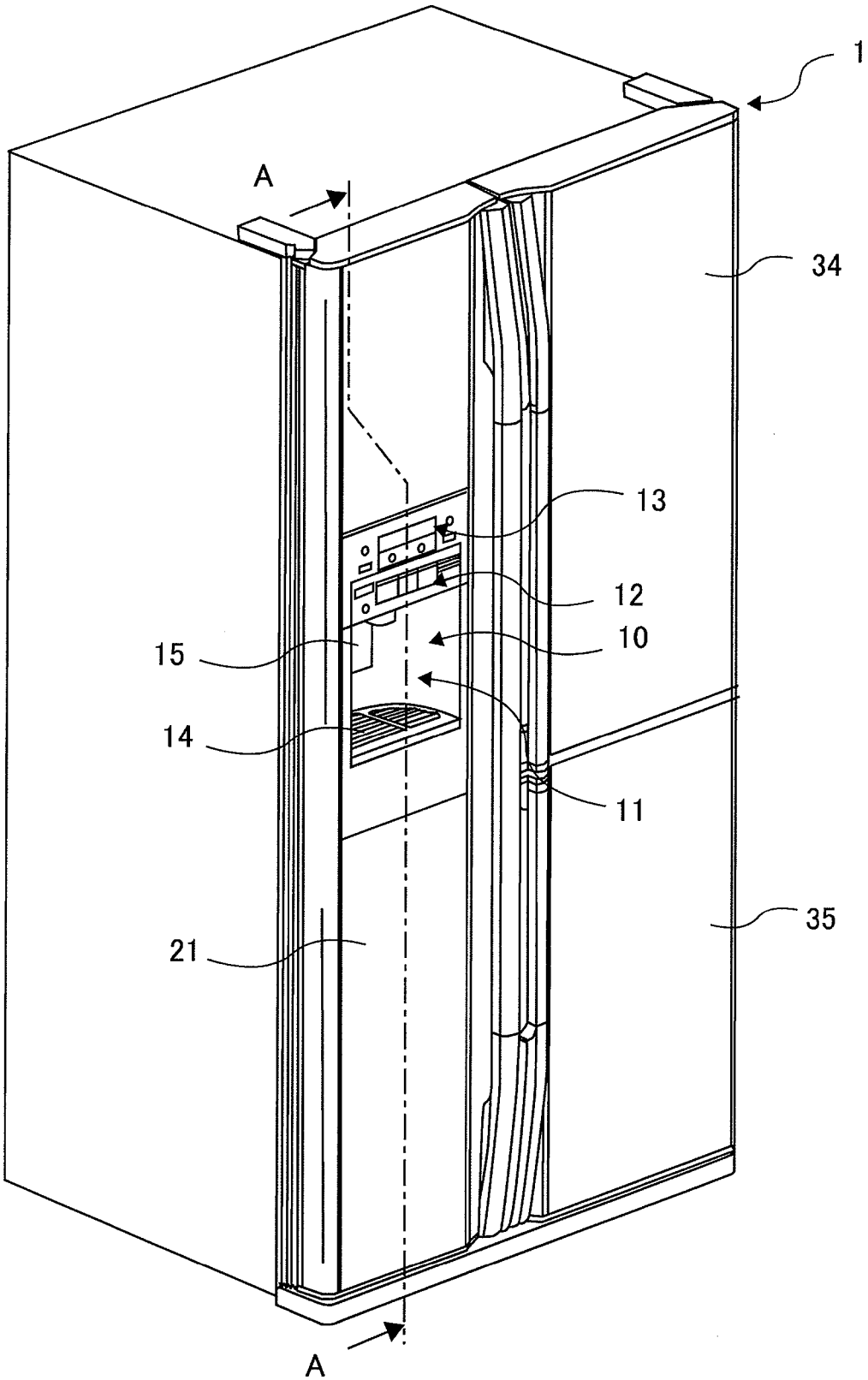
FIG. 1 is a perspective view for showing a refrigerator equipped with an ice supplying apparatus, according to an embodiment of the present invention.
Figure 2:
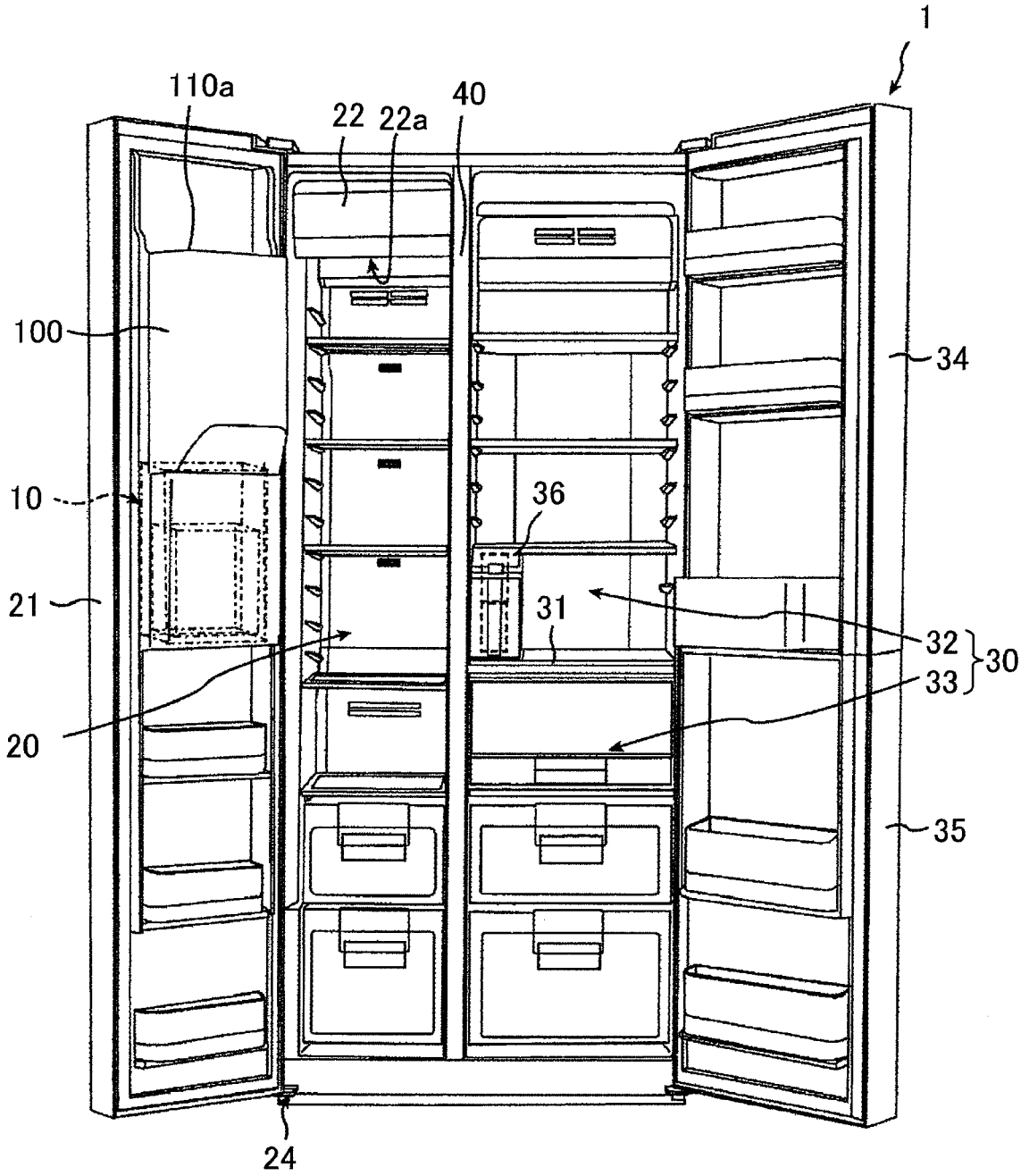
FIG. 2 is a front view of the refrigerator, for showing the condition of opening a door thereof, according to the same embodiment.

A refrigerator 1 according to the present embodiment has an outlook as is shown in FIG. 1, and it has a function of supplying a water and/or ice pieces at a dispenser portion 10, which is provided on a door. This refrigerator 1 is also possible to supply a block-like ice piece (i.e., so-called a block ice) and/or finely crushed ice pieces (i.e., so-called crushed ices). Further, this refrigerator 1 is that of a type, such as, so-called a "side-by-side", and as is shown in FIG. 2, it has such the structures that a storage chamber thereof is separated into the left-hand side and the right-hand side, roughly.

Next, by referring to FIG. 2, explanation will be made on interior structures of the refrigerator 1. The refrigerator 1 has a first storage chamber or room 20, in which the storage temperature is kept to be equal or lower than 0°, a second storage chamber or room 30, in which the storage temperature is kept to be higher than 0°, being disposed on the left-hand side and the right-hand side. In more details, within the refrigerator 1, the first storage chamber 20 on the left-hand side is a freezer chamber (hereinafter, it is called a "freezer room 20", appropriately), and the second storage chamber 30 on the right-hand side is divided into an upper portion and a lower portion through a horizontal partition 31, wherein the upper one is a cold storage room (or, fresh food room) 32 and the lower one is a vegetable room 33. And, a freezer room door 21, a cold storage room (or, fresh food room) door 34 and a vegetable room door 35 are provided corresponding to the freezer room 20, the fresh food room 32 and the vegetable room 33, respectively, and this refrigerator 1 is of a type, so-called "3-doors type".

Next, explanation will be made on the first storage chamber (freezer room) 20. In the freezer room, an ice maker assembly 22 is provided in an upper portion thereof. In this ice maker assembly 22 are produces ice pieces, each being nearly cubic in the shape thereof, and sizes of each ice piece are set to, for example, 42 mm×32 mm×25 mm.

Also, within the refrigerator 1 is provided an ice supplying assembly or apparatus 100 to be used for supplying the ice pieces, which are produced in the ice maker assembly 22, to the dispenser portion 10 mentioned above. Further, within the refrigerator 1 is also provided a water supplying assembly (not shown in the figure) for supplying water.

Figure 3:
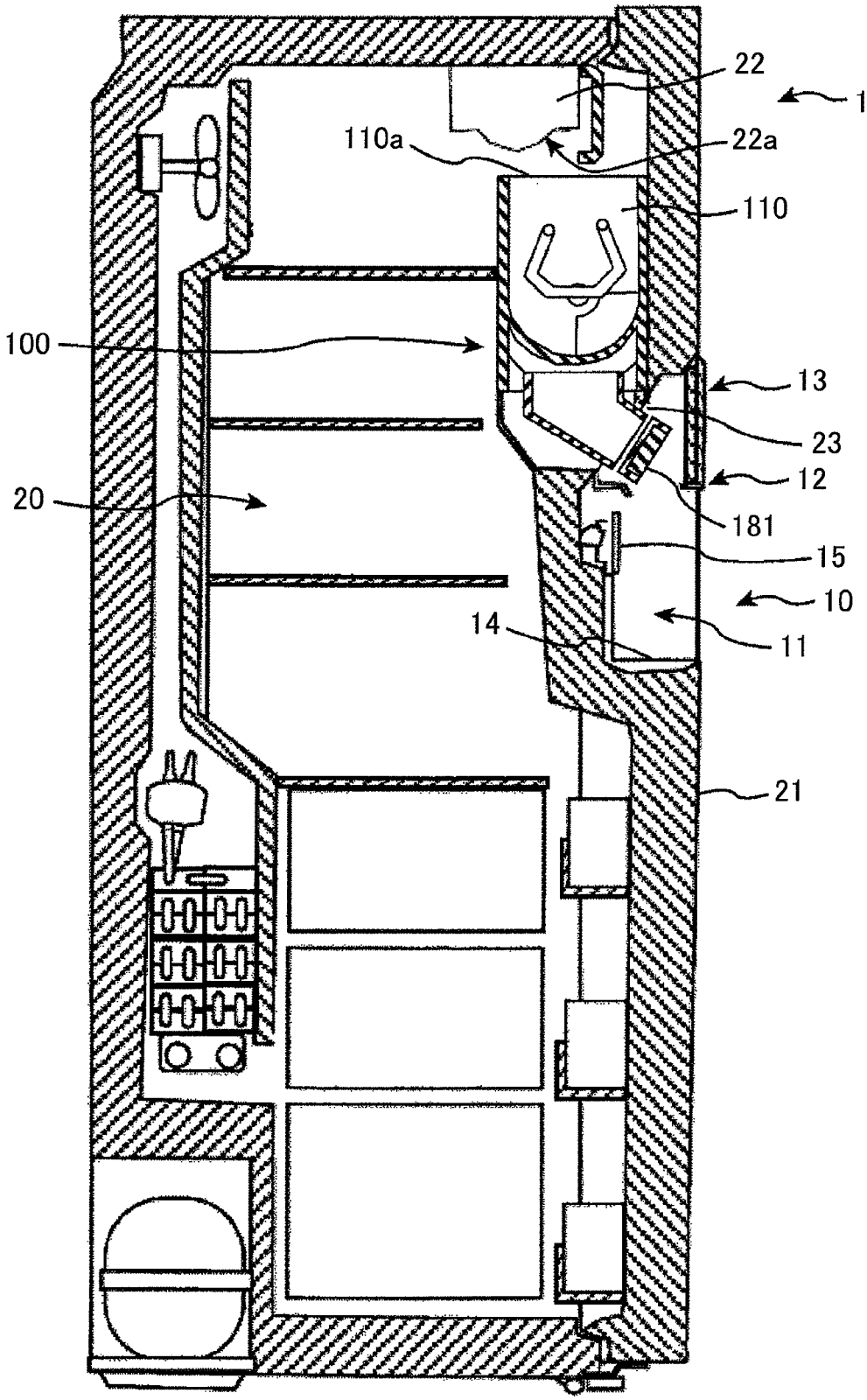
FIG. 3 is a side cross-section view, being cut along an A-A line shown in FIG. 1.

The ice supplying assembly 100 is provided in an inner side of the freezer room door 21. However, the ice maker assembly 22 falls down the ice pieces produced therein from an ice outlet opening 22*a*, and as is shown in FIG. 3, the ice supplying assembly 100 receives the ice pieces in a portion lower than the ice outlet opening 22*a*, in the positional relationship thereof. In more details, an upper opening portion 110*a* of an ice storage portion 110 of the ice supplying assembly 100 is disposed just below the ice outlet opening 22*a* of the ice maker assembly 22. And, the ice supplying assembly 100 is in the condition that it is located to be lower than the ice maker assembly 22, when the freezer room door 21 is closed.

The dispenser portion 10 is, as is shown in FIGS. 1 to 3, provided at a position around middle of the height of the freezer room door 21. In this dispenser portion 10 is built up a service space or area 11 for serving water or ice pieces, and in the position upper than that service room 11 is provided an operator portion or unit 12 for operating the ice supplying assembly 10 and the water supplying assembly, etc., and a display portion or unit 13 for displaying various kinds of information thereon.

In the operator unit 12 are provided buttons corresponding to the services, such as, "water", "block ice" and "crushed ice", for example. On the display unit 13 are provided a display for displaying the various kinds of information thereon and lamps, each being lighten corresponding to the various kinds of information, etc. As the information to be displayed by those is, for example, temperature in the storage room, a remaining amount of water in a water supply tank 36, a kind of the service selected on the operator unit 12, and/or a fact that a driving motor is locked because of a blockage of ice pieces, etc.

Within the service space 11 is a portion, which is formed by bending the freezer room door 21 in the concave-like shape, towards an inside thereof, and below that is provided a mounting portion extending along the horizontal direction, for enabling to put a cup, etc., thereon. The mounting portion is made up with using a net-like material, preferably, so as to cut or remove the drips attaching on the bottom surface of the cup, for example.

Also, within the dispenser portion 10 is provided a lever 15 for operating the ice supplying assembly 100 or the water supplying assembly, by pushing the cup or the like thereupon. However, the water supplying assembly is so provided that an outlet of that water supplying assembly is located within the service space 11 of the dispenser portion 10.

Next, explanation will be made on the freezer room door 21, by referring to FIG. 3. The freezer room door 21 has such structures that an interior and an exterior of the freezer room door 21 are communicated with, in a part thereof. In more details, with the freezer room door 21, the interior and the exterior thereof are communicated with, through a communication opening 23. The communication opening 23 is opened in an oblique direction with respect to the horizontal and vertical directions. And, within an inside of the storage than this communication opening 23 is provided the ice supplying assembly 100. Also, in an outside of the storage than this communication opening 23 is provided the dispenser portion 10. The communication opening of the freezer room door 21 is opened in an oblique direction with respect to the horizontal and vertical directions. Further, the service space 11 of the dispenser portion 10 corresponds to a space in the outside of the storage than the communication opening 23.

Next, explanation will be made on the second storage room 30 (i.e., the fresh food room 32 and the vegetable room 33), by referring to FIG. 2. The second storage room 30 comprises the water supply tank 36, which supplies water to the ice maker assembly 22 and/or the water supplying assembly. This water supply tank 36 is disposed on an upper surface of the horizontal partition 31 separating between the fresh food room 32 and the vegetable room 33 from each other. Also, the water supplying assembly mentioned above is connected with the water supply tank 36 through a conduit, and the conduit for use of the water supplying assembly is provided in such a manner that it reaches to the water supplying assembly, extending from the water supply tank 36 towards a depth direction of the refrigerator 1, up to an outside of the refrigerator 1, and from there further extending to the freezer room door 21 along the rear surface and the bottom surface thereof, and after rising up within the freezer room door 21, while passing through a hinge portion 24 blow the freezer room door 21. On the other hand, the conduit for use of the ice maker assembly 22 is provided in such a manner that it reaches to the ice maker assembly 22, extending from the water supply tank 36 towards the depth direction of the refrigerator 1, up to the outside of the refrigerator 1, but from there directing to a side of the freezer room door 21 along the rear surface and a top surface, and further passing through a housing of the refrigerator from a position on the way of the top surface.

Figure 4:
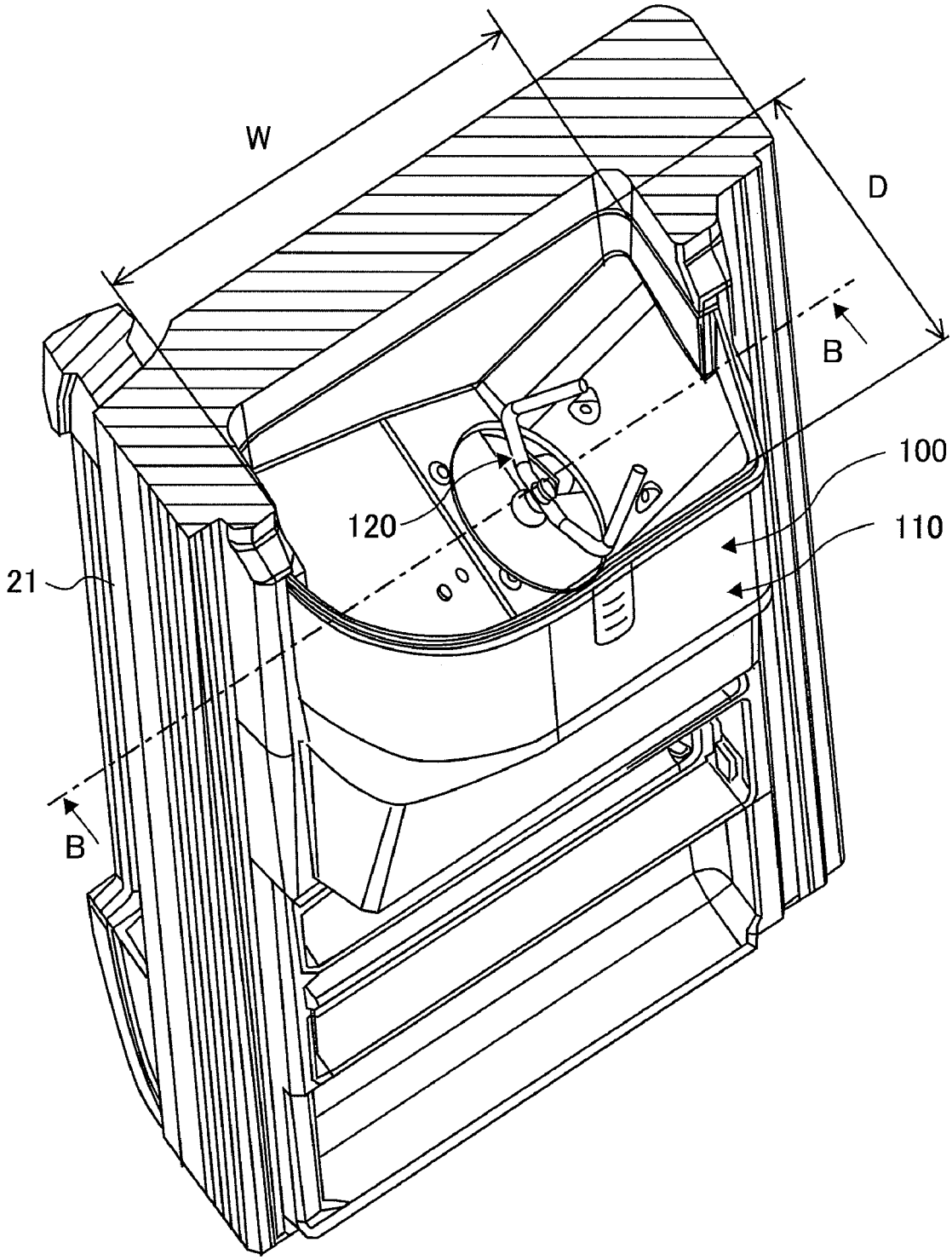
FIG. 4 is a perspective view for showing the condition of attaching the ice supplying apparatus, according to the same embodiment, onto the door of the refrigerator.
Figure 5:
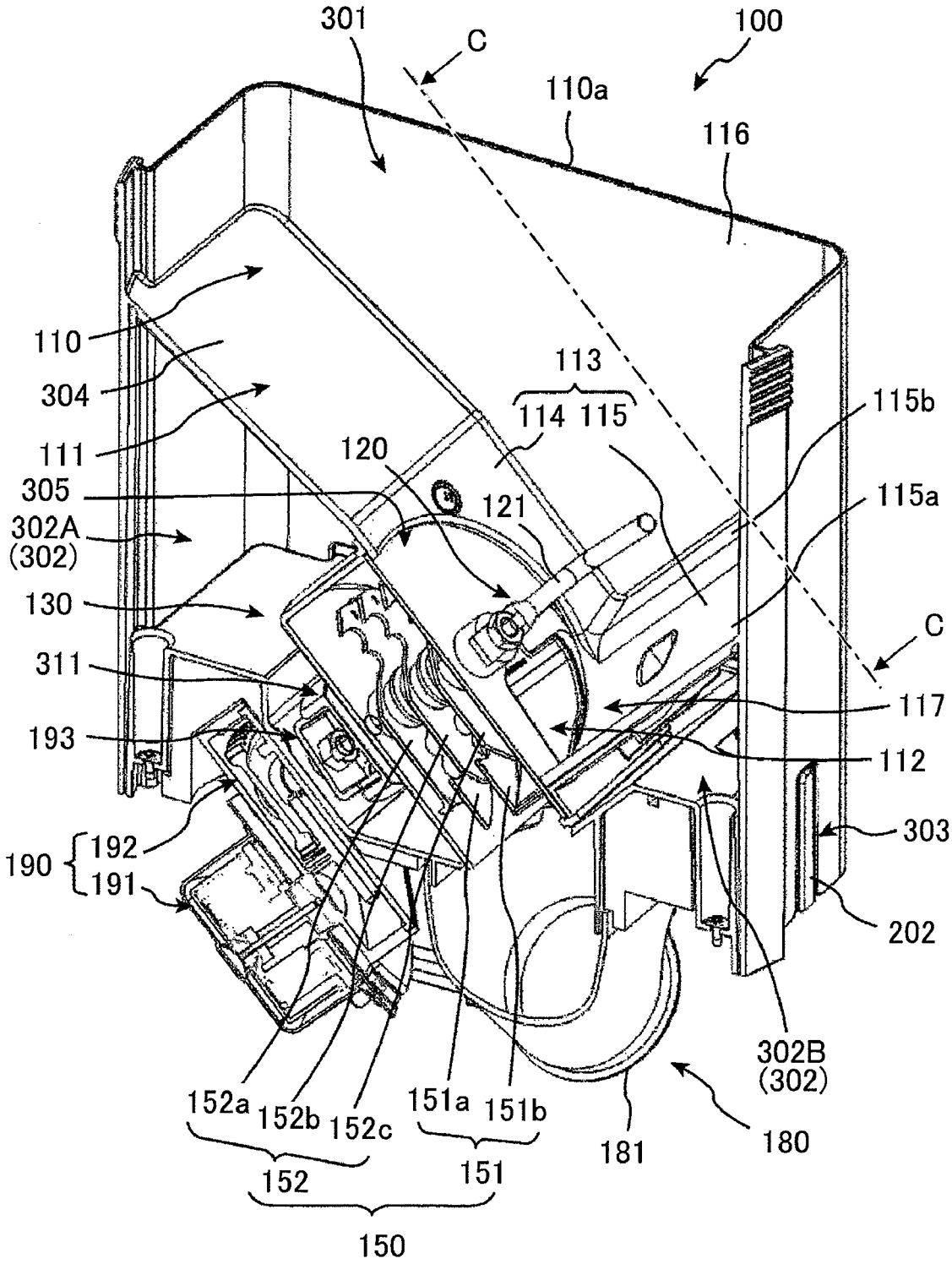
FIG. 5 is a perspective view including a cross-section thereof, for showing the ice supplying apparatus according to the same embodiment, being cut along a B-B line shown in FIG. 4.

Next, explanation will be made on the ice supplying assembly 100, by referring to FIGS. 4 to 7. FIG. 4 is a perspective view for showing the ice supplying assembly 100, which is provided on the freezer room door 21, seeing from an inside of the storage, FIG. 5 is a perspective view of the ice supplying assembly 100, including the cross-section thereof, seeing from the rear surface side, and FIGS. 6 and 7 are rear side cross-section views of the ice supplying assembly 100, seeing from the rear side thereof.

The ice supplying assembly comprises an ice storage portion or unit 110, in which are stored the ice pieces produced by the ice maker assembly 22, a stirrer 120 for stirring the ice pieces stored within the ice storage unit 110, an ice crusher portion or unit 130 being able to crush the ice pieces stored within the ice storage unit 110, and a driver portion or unit 190 for driving those, i.e., the stirrer 120 and the ice crusher unit 130. Also, the ice supplying assembly 100 comprises a hopper portion or unit 180, for supplying the ice pieces into an ice supply portion (i.e., the service space 11 mentioned above) of the dispenser portion 10. Explaining about the positional relationship thereof, the ice storage unit 110 is disposed in an upper position of the ice supplying assembly 100, and the ice crusher unit 130 is disposed lower than the ice storage unit 110, and the driver unit 190 and the hopper unit 180 are disposed lower than the ice crusher unit 130.

Figure 6:
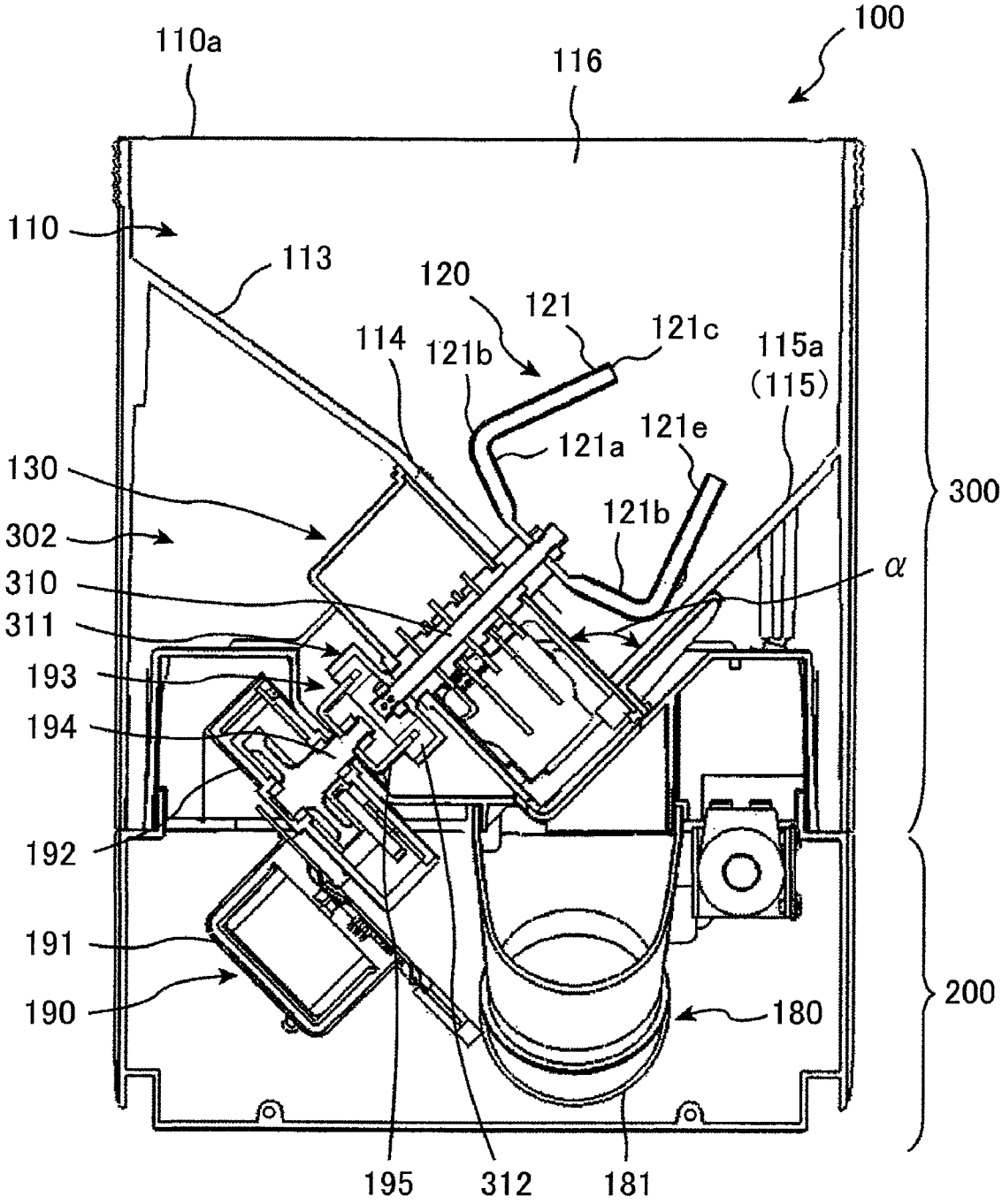
FIG. 6 is a front view for showing the ice supplying apparatus according to the same embodiment, being cut along a B-B line shown in FIG. 4.
Figure 7:
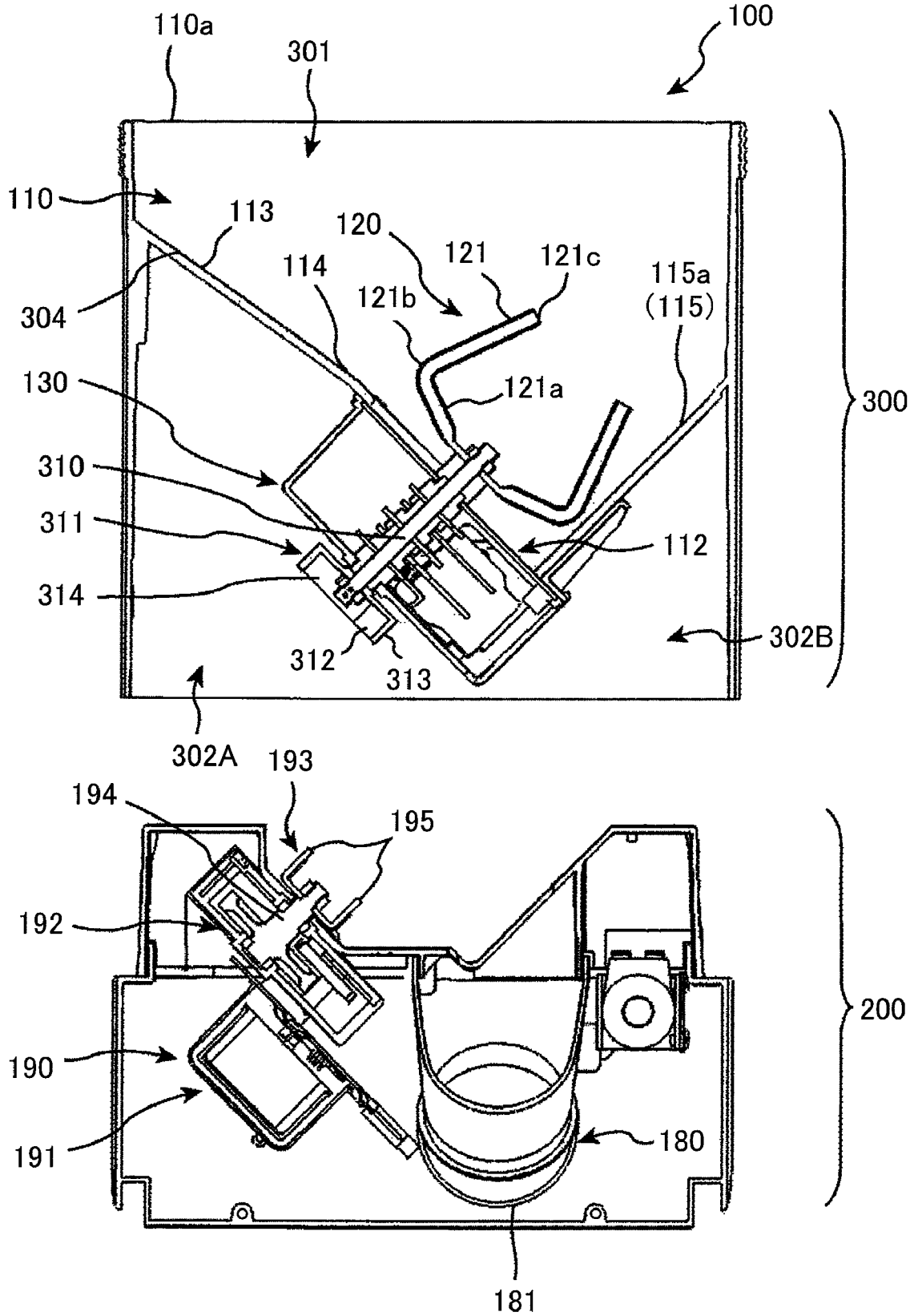
FIG. 7 is a view for showing the ice supplying apparatus according to the same embodiment, in particular, exploding the ice supplying apparatus shown in FIG. 6.

Also, as is shown in FIGS. 6 and 7, the ice supplying assembly 100 is constructed to be dividable between a base member 200 and a main body member 300, which can be attached on that base member 200 in a freely detachable manner. The base member 200 is fixed onto the freezer room door 21 by screws or the like, for example. The base member 200 and the main body member 300 are detachable in the direction of height of the freezer room door 21 (i.e., in the vertical direction). However, this direction will be called a "dividing direction", hereinafter.

In more details, a lower portion of the main body member 300 can be fit into an upper portion of the base member 200. And, in the lower portion of the main body member 300 is provided a space or room, which can receive the upper portion of the base member 200 therein (i.e., a lower-side space 302, which will be mentioned later). In more details, as is shown in FIG. 5, the main body member 300 is provided cutout portions 303, each being cut out in the vertical direction, on both sides thereof in the width direction, and on the base member 200 is provided a projecting portion 201 corresponding thereto. However, the manner for attaching the ice supplying assembly 100 should not be restricted to this. But, FIG. 5 shows the base member 200 and the main body member 300, under the condition of being combined with.

Also, as is shown in FIG. 7, the base member 200 is a member having the driver unit 190 and the hopper unit 180. On the other hand, the main body member 300 is a box-like member, being provided with the ice storage unit 110 on the upper position thereof, and also building the stirrer 120 and the ice crusher unit 130 therein. Thus, an upper portion of the main body member 300 builds up the ice storage unit 110 therewith. In this manner, since the main body member 300 having the ice storage unit 110 can be detached from the freezer room door 21, separating from the base member 200 having the heavy driver unit 190, cleaning or the like can be made on the ice storage unit 110, easily.

The main body member 300 (i.e., the ice storage unit 110) is shaped, as shown in FIG. 4, into a configuration of being about square, when seeing it from an upper surface thereof, and in more details thereof, it has the configuration of being about oblong, having one side "W" longer than other side "D". Also, the main body member 300 is attached onto the freezer room door 21, in such a manner that a direction along the shorter side "D" of the ice storage unit 110 (i.e., a short side direction) comes along the depth direction of the freezer room door 21 while turning a direction along the longer side "W" (i.e., a long side direction) along the width direction of the freezer room door 21 (see FIG. 2). Further, the ice supplying assembly 100 is rounded at a corner, which is at a tip when opening/closing the freezer room door 21, between two (2) pieces of corners turning to an inside of storage when they are attached onto the freezer room door 21.

The hopper unit 180 mentioned above is disposed, as shown in FIG. 3, so that a tip portion thereof is located within the service space 11 of the dispenser portion 10. Thus, the tip portion of the hopper unit 180 is provided so as to project from the communication opening 23 mentioned above into the service space 11. Also, at the tip portion of the hopper unit 180 is provided a cover (or, a dumper) 181 for shutting off the communication of air between the inside and the outside of the refrigerator. That cover 181 is driven to open/close by an actuator, such as, a solenoid or the like, for example.

The ice storage unit 110 has, as shown in FIG. 5, a shrinking portion 111, being shaped to be small in an interior space, as it goes down to a lower portion thereof (i.e., an upper space 301, which will be mentioned later), and in a lower portion of this shrinking portion 111 is provided an ice discharger portion 112. Thus, the shrinking portion 111 has a shape of becoming narrower in the cross-section configuration along the horizontal direction, gradually, as it goes down to a lower portion thereof. In more details, the shrinking portion 111 is defined by inclining a lower surface, for supporting the ice pieces stored from a lower portion thereof, with respect to the horizontal direction, among the interior surfaces defining the interior space of the ice storage unit 110. In more details, the shrinking portion 111 is defined by an oblique surface 113 inclining with respect to the horizontal direction. With this, the ice storage unit 110 has a configuration being narrow as it goes down to the lower portion thereof. Also, on this oblique surface 113 is provided the ice discharger portion 112 mentioned above. The ice discharger portion 112 is provided as an ice discharging opening, which is formed at the lowest portion of the oblique surface 113, and the ice discharger portion 112 has an opening of such a size that, one (1) or two (2) pieces of the ice pieces, which are produced in the ice maker assembly 22, can pass therethrough.

By the way, the inclination angle of the oblique surface 113 is arbitrary, as far as the inclination angle has such an angle that the so-called dried ice pieces, i.e., not melding on the surfaces thereof, can fall down sliding thereon, when mounted thereon. Also, the oblique surface 113 is so determined to incline with respect to the longitudinal direction of the ice storage unit 110.

The oblique surface 113 is built up with two (2) pieces of crossing surfaces 114 and 115, crossing with each other. Or, the oblique surface 113 is formed as a bent surface, joining two (2) pieces of surfaces 114 and 115, each having an angle. And, the ice discharger portion 112 is disposed in the vicinity of crossing portion of two (2) crossing surfaces 114 and 115. In more details, the ice discharger portion 112 is provided on a crossing surface 114 of one of the two (2) crossing surfaces 114 and 115. Further in more details, the ice discharger portion 112 is so provided that a portion thereof is involved in a boundary portion between the two (2) crossing surfaces 114 and 115.

One crossing surface 114 of those two (2) pieces of the crossing surfaces 114 and 115 is formed to be flat in shape thereof. However, strictly saying, this one crossing surface 114 is constructed with two (2) pieces of portions, differing from each other in the inclination angle of about 10 degrees, between an upper one and a lower one, but for the ice pieces, they can be considered to be flat, substantially.

Also, the other surface 115 has a concave portion 115*a*, being formed to extend along the longitudinal direction mentioned above. In more details, the concave portion 115*a* is provided to be continuous with the ice discharger portion 112. Further, in more details, the concave portion 115*a* is formed at a central portion of the short side direction mentioned above.

Figure 8:
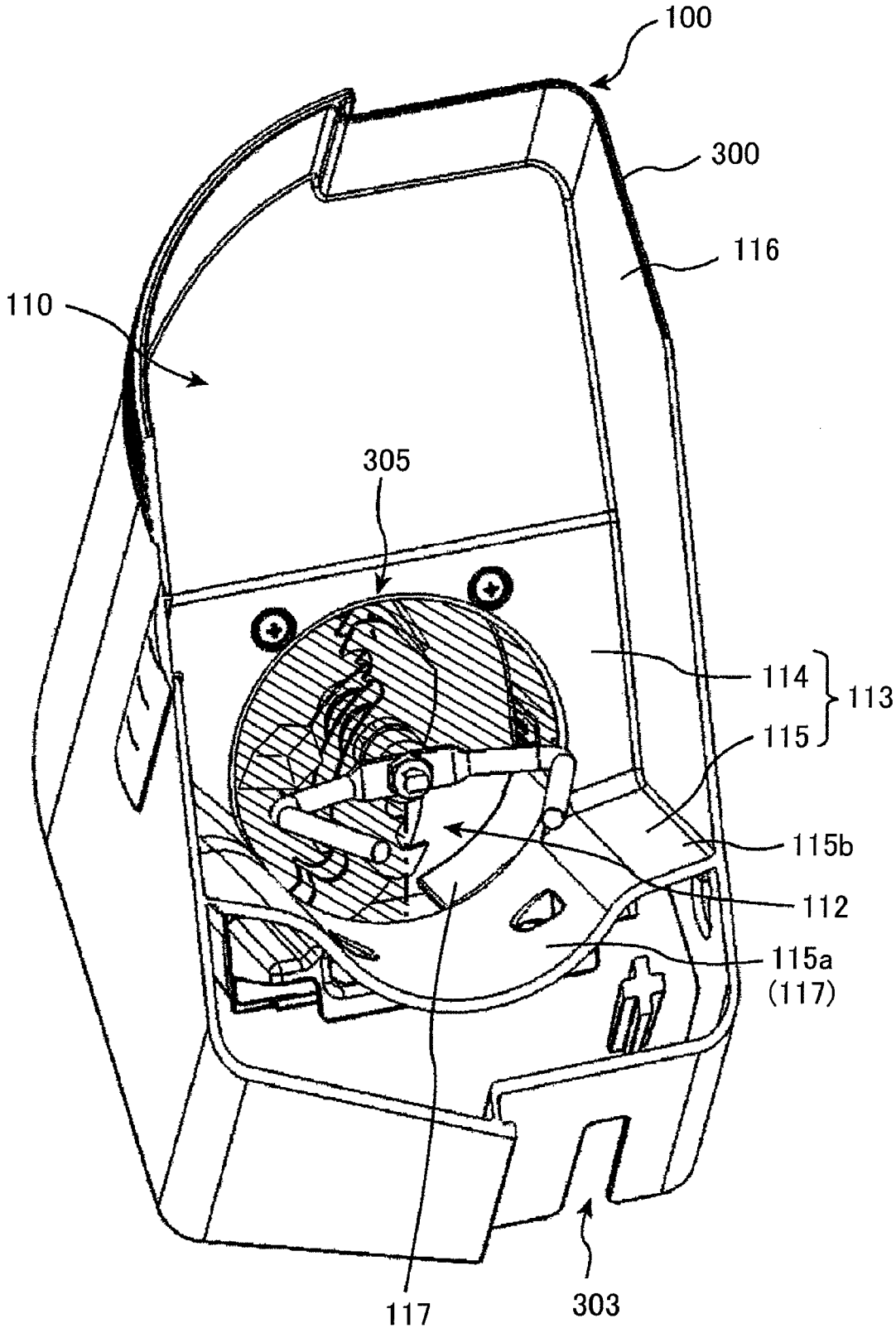
FIG. 8 is a perspective view including a cross-section thereof, for showing the ice supplying apparatus according to the same embodiment, being cut along a C-C line shown in FIG. 5.
Figure 9:
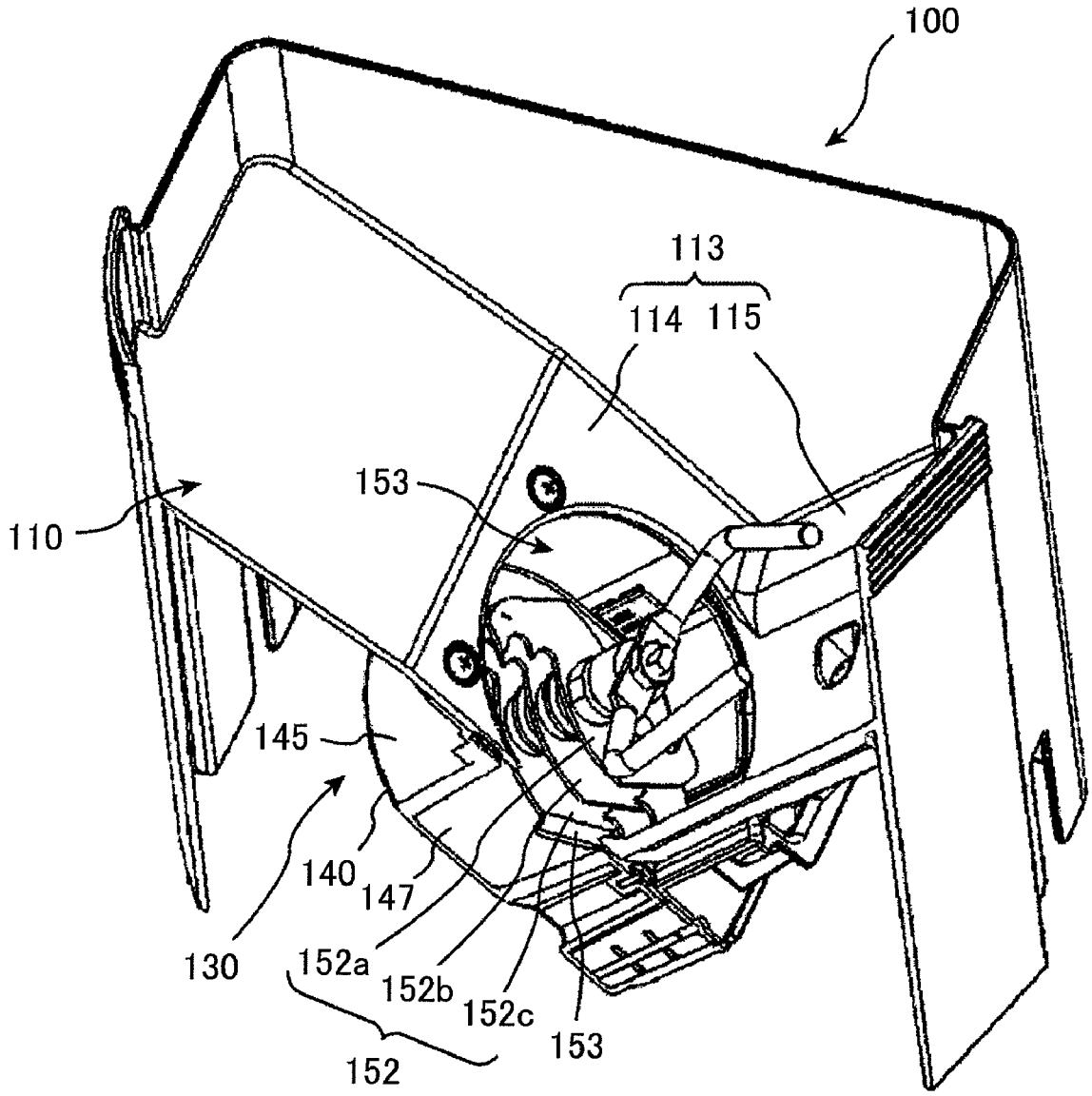
FIG. 9 is a perspective view including a cross-section thereof, for showing the ice supplying apparatus according to the same embodiment.

Also, the concave portion 115*a* is provided to be a curved surface. In more details, as shown in FIG. 8, the concave portion 115*a* has a circular arc on the cross-section thereof. Further, FIG. 8 is a view for showing the ice storage unit 110, under the condition of cutting out along a C-C line shown in FIG. 5. Also, a portion of an opening 305, which will be mentioned later, among the crossing surface 114, is shown by slanting lines in portion, so as to be seen the interior structures thereof.

By the way, this concave portion 115*a* functions as a guide portion 117 for guiding the ice pieces into the ice discharger portion 112. Thus, on the oblique surface 113 is provided the guide portion 117 for guiding the ice pieces to the ice discharger portion 112, extending towards to the ice discharger portion 112, and that guide portion 117 is formed to be hollow, i.e., concave-like.

Also, the other crossing surface 115 has flat portions 115*b* on both sides in the short side direction. Each flat portion 115*b* is, as can be seen from FIGS. 4, 5 and 8, is inclined with respect to both directions, i.e., the short side direction and the long side direction, but it is inclined to the long side direction by an angle, larger than that to the short side direction. And, the inclination of the flat portions 115*b* with respect to the short side direction also brings the boundary portion, which is defined by crossing of the two (2) crossing surfaces 114 and 115, to be inclined with respect to the short side direction mentioned above. And, the flat portion 115*b* is also inclined so that it goes down to a lower side as it is in the vicinity of the ice discharger portion 112. Thus, on the lower surface of the ice storage unit 110, there is no such the horizontal portion that the ice pieces can be mounted with stability, substantially. For this reason, within an inside of the ice storage unit 110, at any position thereof, it is possible to function an external force towards the ice discharger portion 112 upon the ice pieces.

The two (2) crossing surfaces 114 and 115 cross each other, as can be seen from FIGS. 6 and 7, by an angle of about 90 degrees. Also, each of the crossing surfaces 114 and 115 is disposed to incline by about 45 degrees with respect to the horizontal direction. However, the crossing angle "α" between the two (2) crossing surfaces 114 and 115 should not be restricted to that, i.e., about 90 degrees, but may be about 45 degrees or 120 degrees, for example; it may be determined, arbitrarily.

By the way, on the main body member 300 is provided a dividing portion to divide an interior space into an upper one and a lower one, roughly. The interior space of the main body member 300 is divided into the upper space 301 and the lower space 302. The upper space 301 comes to be a storage space, and the lower space 302 comes to be a receiving space for receiving the base member 200 and/or the ice crusher unit 130 therein. And, disposing this dividing portion 304 to be inclined defines the oblique surface 113 (i.e., the crossing surfaces 114 and 115).

However, on the dividing portion 304 is provided the opening 305 at a portion corresponding to the crossing surface 114, and the ice crusher unit 130, which will be mentioned later, is attached thereon, so as to close this opening 305. In more details, on one of the two (2) crossing surfaces 114 and 115 building up the oblique surface 113 is formed the opening 305 nearly in a round shape. And, when attaching the ice crusher unit 130 thereto, then an upper surface 146 of an ice crusher chamber 140 comes into a mode of closing the opening 305, and thereby completing the one crossing surface 114 mentioned above, having no other communication portion than the ice discharger portion 112.

Also, the two (2) crossing surfaces 114 and 115 cross each other at the position biasing to either one end of the long side direction mentioned above, on the ice storage unit 110. Thus, the crossing portion of the two (2) crossing surfaces 114 and 115 (i.e., a valley portion, at which the interior space is the smallest) is disposed at the position biasing to either one end of the long side direction mentioned above, on the ice storage unit 110. With this, a space 302A defined below the crossing surface 114 within the lower space 302 mentioned above is larger than a space 302B, which is defined below the crossing surface 115. Accordingly, it is possible to receive therein the driver unit 190 and the ice crusher unit 130, which will be mentioned later, preferably, without jutting out from a projection area of the main body member 300.

Next, explanation will be made on the stirrer 120. The stirrer 120 is constructed to have a stirring body or member 121 for stirring the ice pieces within the ice storage unit 110. In more details, the stirring member 121 is disposed within the ice storage unit 110, to be rotatable. The stirring member 121 is driven, normally, to rotate in a predetermined direction (i.e., into an anticlockwise direction, in FIG. 8, etc.). However, this can rotate in the reverse direction, when an abnormality occurs, such as, blocking of the ice pieces or the like, for example, for the purpose of dissolving this.

Also, the stirring member 121 is disposed to rotate around a rotation shaft (or a rotation axial line), which is determined to incline with respect to the horizontal direction. With this, it is possible to cause convection (or circulation) of the ice pieces within the ice storage unit 110. In more details, the rotation shaft is set into a direction perpendicular to the one crossing surface 114 mentioned above, in the oblique surface 113, while to be in parallel with the other crossing surface 115 mentioned above. However, the rotation shaft is disposed to be coincident with a center of an arc of the concave portion 115*a* having the circular art in the cross-section thereof.

The stirring member 121 is disposed projecting above from a lower portion of the ice storage unit 110 (i.e., a lower portion of the shrinking portion 111). The stirring member 121 has such a bent configuration that, as shown in FIGS. 6 and 7, a middle portion 121*b* is disposed at a position far from the rotation shaft, comparing to a base-end portion 121*a*, and further a tip portion 121*c* is disposed at a position close to the rotation shaft than the middle portion 121*b*. In more details, the middle portion 121*b* is bent about 90 degrees.

Also, the stirring member 121 is in the condition of being inclined with respect to an interior surface of the ice storage unit 110 mentioned above, at any angular position thereof. Accordingly, even if putting the ice pieces into a gap between the oblique surface 113 and a vertical surface 116 when the stirring member 121 rotates, since it is possible to let the ice pieces to escape from that gap accompanying with rotation of the stirring member 121, therefore there is no chance that the ice pieces are crushed or powdered within the ice storage unit 110, unexpectedly.

In more details, within the stirring member 121, a first arm portion 121*d* facing to the crossing surface 114 rotates under the condition of being inclined with respect to the crossing surface 114 at any angular position. Further, this first arm portion 112*d* corresponds to a portion starting from the base-end portion 121*a* and reaching to the middle portion 121*b*. Also, a second arm portion 121*e* facing to the crossing surface 115 and the vertical surface 116 rotates under the condition of being inclined with respect to the crossing surface 115 and the vertical surface 116, at any angular position thereof. Further, this second arm portion 121*e* corresponds to a portion starting from the middle portion 121*b* and reaching to the tip portion 121*c*. Also, the first arm portion 121*d* and the second arm portion 121*e* are so provided that the former comes to be far from the crossing surface 114 than the base-end portion 121*a* as it reaches to the middle portion 121*b*, and the latter comes to be far from the facing surfaces (i.e., the crossing surface 115 and the vertical surface 116) than the middle portion 121*b* as it reaches to the tip portion 121*c*.

However, if expressing an amount of projection from the crossing surface 114 directing to the rotation shaft is "height", then the middle portion 121*b* is disposed at a position equal to a half (½) of the height of the stirring member 121 (preferably, ⅓). Also, a rotation radius of the middle portion 121*b* is determined to be about a half (½) of the rotation radius of the tip portion 121*c*.

Preferably, two (2) sets of stirring members 121 are provided, wherein those two (2) sets of the stirring members 121 are disposed at the same location at the base-end portion thereof, and they are disposed to dividing from that location. Further, those two (2) sets of the stirring members 121, under the condition of being combined with, have such an entire configuration that they expand from the base-end portion to the middle portion and narrowed from the middle portion to the tip portion. However, the stirring members 121 should not be restricted to the two (2) pieces, but may be one (1) or three (3) or more than that.

Also, the stirring members 121 are disposed to be rotatable, but without interfering with an interior surface defining the interior space of the ice storage unit 110 (i.e., the crossing surface 114 and 115, and also the vertical surface 116 defining the ice storage unit 110, which as the oblong configuration seeing from an upper surface). By the way, a gap or distance between a rotation area of the stirring members 121, which can be defined by passages of the rotating stirring members 121, and the interior surface of the ice storage unit 110 differs from, depending upon the angular position of the stirring members 121.

Also, within a space defined between the rotation area mentioned above and the interior surface of the ice storage unit 110, there are provided the following regions; i.e., a region being smaller in sizes than the ice pieces, which are stored in the ice storage unit 110, and a region larger than that. In particular, the gap or distance between the rotation area of the stirring members 121 and a concave-like portion 115*a* is determined to be smaller in the size than one (1) piece of the ice. Also, the rotating area of the stirring members 121 is in the mode that it enters into a concave-like space surround by the concave-like portion 115*a*. Further, the concave-like portion 115*a* can be identified as a portion for the rotating stirring members 121 to escape therein.

With such structures, even if combining a plural number of the ice pieces, into a block of ice having such a size that it cannot pass through the ice discharger portion 112, for example, but this block of ice is pushed onto the interior surface of the ice storage unit 110 while being put between the stirring member 121 and that interior surface, when this block of ice rotates within the ice storage unit 110 together with the stirring members 121, in the mode thereof, and then it is possible to dissolve (or, crack) the block of ice into each of the ice pieces, individually.

By the way, the rotation area of the stirring members 121 is determined corresponding to the ice discharger portion 112. In more details, the ice discharger portion 112 is so provided that a projection area, which is obtained by projecting the rotation area of the ice discharger portion 112 onto a plane perpendicular to the rotation shaft (in more details, the crossing surface 114), is coincident, or overlaps in a part, with the ice discharger portion 112. In more details, the ice discharger portion 112 is provided in such a manner that, within the projection area mentioned above, at least a portion thereof is located in an area below a line, extending along the horizontal direction and passing through the rotation shaft mentioned above. Further, in more details, the ice discharger portion 112 is formed in shape of a circular arc, covering over an angular extent extending from the angular position when the stirring members 121 go down to the lowest until when the stirring members 121 turns to about 90 degrees in the rotating direction.

With such the structures, the ice pieces lying in the lower portion of the shrinking portion 111 are transferred up to the ice discharger portion 112 by means of the rotating stirring members 121. Accordingly, it is possible to discharge the ice pieces into the ice storage unit 110, without the remaining.

Next, explanation will be upon the ice crusher unit 130.

The ice crusher unit 130 is constructed to be changeable between modes, i.e., one for servicing the ice pieces produced by the ice maker assembly 22 as they are, not crushing them, and the other for serving the ice pieces under the condition of being crushed finely. In more details, in the ice crusher unit 130 is provided a passage or route P, through which the ice pieces pass when they moves from the ice discharger portion 112 to an ice supply location, while being divided into two (2) paths P1 and P2. However, the details of the passage P will be mentioned, later, by referring to FIG. 11.

The ice crusher unit 130 has an ice crusher room 140 to be user when crushing the ice pieces, and a crushing member 150, which is disposed within the ice crusher room 140.

The crushing member 150 is made up with a pair of edges 151 and 152, which movers relatively each other, wherein the ice piece is crushed by putting an ice piece between the pair of edges 151 and 152. In more details, the pair of edges 151 and 152 is constructed, so that one edge 151 is fixed, while the other edge 152 is movable. However, hereinafter, for convenience of explanation, the one edged mentioned above is called a "fixed edge 151" while the other mentioned above is called a "movable edge 152".

In more details, the other edge 152 is constructed to be rotatable. Also, the other edge 152 is disposed to rotate around a center of the rotation shaft (or, the rotation axial line), which is set to incline with respect to the horizontal direction.

The movable edge 152 normally rotates into a predetermined direction (i.e., in the anticlockwise direction in FIG. 1), when it is in any one of crushing/non-crushing modes. However, in case where an abnormality occurs, such as, the blocking of the ice pieces, for example, it can be changed to rotate in the reverse direction, so as to dissolve this.

Preferably, the fixed edges 151 and the movable edges 152 are provided in plural numbers thereof, and the edges 151 and 152 are disposed at the positions shifting into direction of the rotation shaft, with each other. In more details, the fixed edges 151 are provided in two (2) pieces, and the movable edges 152 are three (3) pieces thereof. However, hereinafter, when designating each of the fixed edges 151, individually, an alphabet is use as a subscript, such as, 151*a*, 151*b*, for example. This is also same to each of the movable edges 152.

Each of the movable edges 152*a* to 152*c* rotates in a mode of passing by the fixed edges 151*a* and 151*b* with keeping a space therefrom. The fixed edges 151*a* and 151*b* themselves are disposed at the same angular position in the rotation direction. And, the movable edges 152*a*, 152*b* and 152*c* rotate by themselves under the condition that they overlap with each other in the rotation direction. In more details, they are disposed, shifting by about 2 degrees from one another. Also, the movable edge 152*a* at the uppermost is disposed at the most front side in the rotation direction. Further, each of the movable edges 152*a* to 152*c* has a configuration, extending like a straight line around the rotation shaft. Accordingly, during the time-period when the movable edges rotate one round, it is possible to crush the ice pieces two (2) times between the fixed edges 151.

By the way, the rotation shaft of the movable edges 152 is disposed to incline with respect to the horizontal direction, and in the similar manner, the ice crusher room 140 mentioned above, which is nearly in a cylindrical shape, is disposed to incline the height direction thereof with respect to the horizontal direction. Accordingly, the movable edges 152 rotate within a plane inclining with respect to the horizontal surface.

Also, each of the pair of edges 151 and 152 has a convex portion at each of the end portions facing to the ice pieces with putting it therebetween. With this, local forces are applied onto the ice pieces by the convex portions of the edges 151 and 152, thereby crushing the ice pieces, easily.

Figure 10:
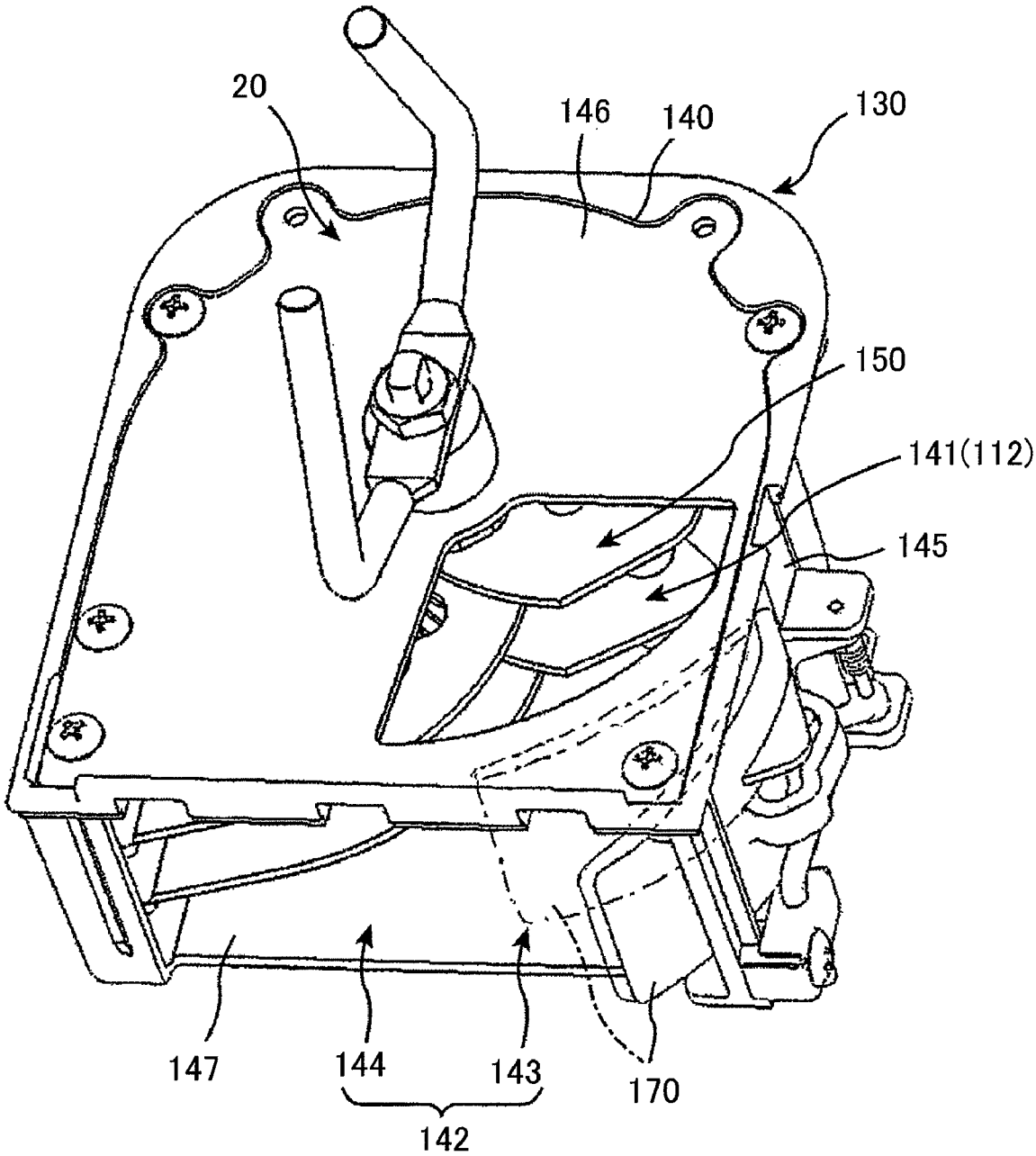
FIG. 10 is a perspective view for showing an ice crushing portion, which is provided within the ice supplying apparatus according to the same embodiment.

Also, the ice crusher unit 130 has, as shown in FIG. 10, a raking portion 153 for raking the ice pieces, which can be filed on a bottom surface 147 of the ice crusher room 140. However, in FIG. 10, on the crossing surface 114, a portion of the opening 305, which will be mentioned later, is shown under the condition of being opened, so as to see the inner structures thereof. In more details, the raking portion 153 is provided on the movable edge (i.e., the movable edges nearest to the bottom surface 147 of the ice crusher room 140) 152*c*, which is disposed at the lowest among those movable edges 152*a* to 152*c*. In more details, the raking portion 153 is made up by bending an end of the movable edge 152*c* having a flat shape, on the rear side in a forward direction, in the rotation direction thereof. However, the raking portion 153 may be provided, separately from the moving edge 152*c* mentioned above.

By the way, the stirring members 121 and the movable edges 152 are provided to be coincident with the rotation shafts thereof. In more details, the stirring members 121 and the movable edges 152 are provided on a same shaft member 310, and therefore it is possible to rotate the stirring members 121 and the movable edges 152 at the same time by rotationally driving that shaft member 310. Also, the stirring members 121 and the movable edges 152 are disposed around the periphery of the shaft member 310, but shifting by about 90 degrees from each other.

The ice crusher room 140 has such an interior configuration that the movable edges 152 can rotate without interfering with an interior wall thereof. Also, the ice crusher room 140 is provided in such a manner that a space between a rotation area, which can be defined by passages of the rotating movable edges 152, and the interior wall of the ice crusher room 140 comes to be smaller than the size of the ice piece to be crushed therewith. In more details, the inner space of the ice crusher room 140 is formed to be nearly cylindrical in the shape, corresponding to the movable edges 152, which are rotationally driven.

Also, the ice crusher room 140 is provided as a box-like body having an input portion 141, into which the ice pieces discharged from the ice discharger portion 112 of the ice storage unit 110, and a release unit 142 for releasing the ice pieces inputted to an outside. Herein, the ice crusher room 140 is communicated with the ice storage unit 110 through the ice discharger portion 112, and the input portion 141 corresponds to the ice discharger portion 112 of the ice storage unit 110, but for the purpose of convenience of explanation, it will be explained by attaching other name and other reference numeral therewith.

The input portion 141 is provided as an ice input opening, which is formed on an upper surface 146 of the ice crusher room 140. In more details, the input portion 141 is formed in shape of a circular arc, covering an angular extent of about 90 degrees from the angular position where the movable edges 152 comes down to the lowest up to about 90 degrees in the rotation direction of the movable edges 152. Also, the release unit 142 is so provided to open directing to below, so as to allow the ice pieces to fall down in a mode thereof, i.e., to release. In more details, the release unit 142 is provided at the portion corresponding to a side wall of the ice crusher room 140 having the box-like shape, and the ice crusher room 140 is disposed to incline with respect to the horizontal direction, thereby being in a mode that the release unit 142 opens directing below obliquely with respect the vertical direction.

Also, the release unit 142 is built up with two (2) sets of release portions 143 and 144, which are provided corresponding to the two (2) sets of paths P1 and P2 mentioned above, and in more details, as is shown well in FIG. 10, it is made up with a first release portion 143 for releasing the ice pieces without crushing and a second release portion 144 for releasing the ice pieces with crushing. The first release portion 143 is provided to communicate with the input portion 141 mentioned above, in the vertical direction.

In more details, the ice crusher room 140 nearly in the cylindrical shape is not provided with a peripheral wall 145 covering over a predetermined angular extent around the rotation shaft of the movable edges 152, and this portion becomes the release unit 142. Thus, the release unit 142 is defined by cutting out the peripheral wall 145 of the ice crusher room 140 nearly in the cylindrical shape, covering over the predetermined angular extent.

Also, the first release portion 143 and the second release portion 144 are disposed on both sides of the movable edges 152, in the rotation direction thereof, putting the angular position when the movable edges 152 comes down to the lowest therebetween. In more details, the first release portion 143 and the second release portion 144 are provided in such a mode, that the release portion 142 opening covering over the predetermined angular extent is divided by the angular position when the movable edges 152 comes down to the lowest. Further in more details, the release unit 142 is formed covering over an angular extent of about 120 degrees, while the first release portion 143 opens covering over the angular extent of about 90 degrees and the second release portion 144 covering over the angular extent of about 30 degrees.

By the way, the ice crusher room 140 is disposed to incline the bottom surface 147 thereof, and then the ice pieces slide down directing below. Accordingly, for the purpose of releasing the crushed ice, not from the first release portion 143, but from the second release portion 144, it is necessary to crush the ice pieces when the movable edges 152 rotate from the upward to the downward. For this reason, the fixed edges 151 are disposed, not in a rising region where the movable edges 152 rotate upwards, but in a falling region where they rotate downwards.

Thus, the fixed edges 151 are provided in an angular extent of 180 degrees, extending from the upper position (i.e., the angular position where the movable edges 152 come up to the uppermost) to the lower position (i.e., the angular position where the movable edges 152 come down to the lowest) within the angular extent of the movable edges 152. In more details, the fixed edges 151 are disposed extending from the rotation center of the movable edges 152 direction below, obliquely.

Also, for the ice crusher room 140, it is necessary to prevent the ice pieces from being moved to a side of the second release portion 144, under the condition that an exchanger or switching body 170 closes the first release portion 143. For this reason, a gap between the fixed edges 151 and the switching body 170 under the condition of advancing is determined to be smaller than the size of the ice piece. Thus, the fixed edges 151 function as a blocking body for blocking movement of the ice pieces.

Figure 11A:
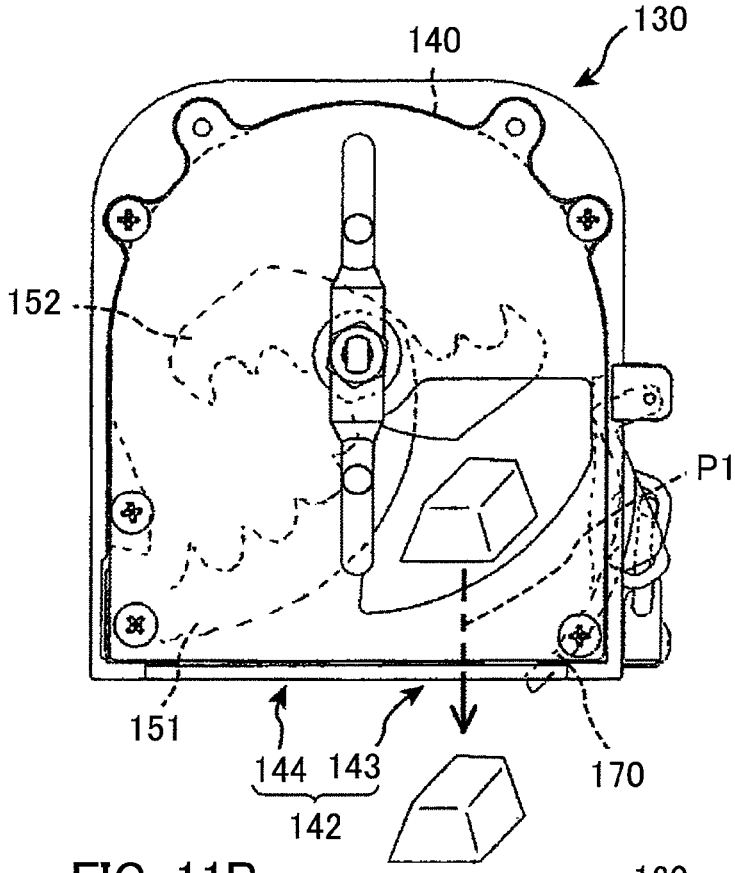
FIGS. 11A and 11B are views for explaining a passage when the ice pieces pass through the ice crushing portion, which is provided within the ice supplying apparatus according to the same embodiment; in particular.
Figure 11B:
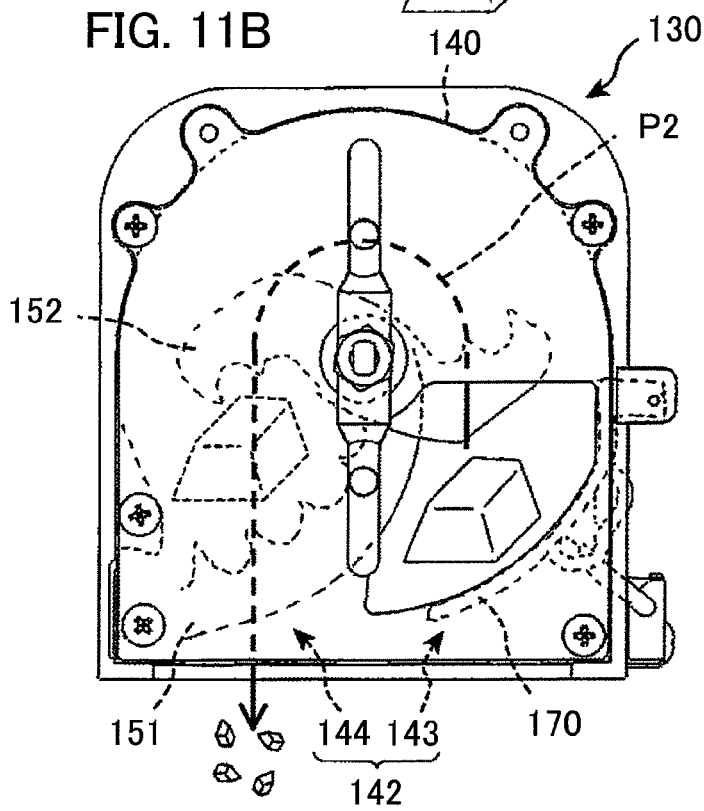

Next, explanation will be made, hereinafter, on the structures of the ice crusher unit 130, which can exchange between the mode of crushing the ice pieces and the mode of not crushing, by referring to FIGS. 10 and 11.

Within the ice crusher unit 130 is provided the switching body 170 for exchanging the passage P for the ice pieces to pass through when moving from the ice discharger portion 112 to the ice service location. And, by means of that switching body 170, the passage P for the ice pieces is exchanged between two (2) paths, i.e., the one path P1 when servicing the ice pieces without crushing and the other path P2 when serving the ice pieces with crushing.

In more details, the switching body 170 is constructed to exchangeable between an advancing condition of advancing to the position to close or shutdown a portion of the release unit 142 (i.e., the first release portion 143), and a retracting condition of retracting to the position for not closing.

The switching body 170 has a configuration corresponding to the first release portion 143 of the ice crusher room 140, and it is so constructed that it closes that first release portion 143 under the retracting condition thereof. Therefore, such the switching body 170 functions as a cover to close the first release portion 143. In more details, that switching body 170 is supported on the peripheral wall of the ice crusher room 140, at an end thereof, to be rotatable. Also, the switching body 170 has a curvature radius nearly equal to the peripheral wall of the ice crusher room 140, and further it is formed to cover the angular extent (i.e., about 90 degrees), being nearly equal to the above-mentioned predetermined angular extent, in which the first release portion 143 is provided. Accordingly, the switching body 170 closes the first release portion 143 in the mode of building up a portion of the peripheral wall 145 nearly in the cylindrical shape.

Further, the switching body 170 is determined in the curvature radius, also to be equal to that of the concave-like portion 115*a* having the circular arc shape in the cross-section thereof, and when it advances to the position to close the release unit 142, it defines a continuous surface continuing with the concave-like portion 115*a*. With this, the ice pieces are guided from the concave-like portion 115*a* into an inside of the ice crusher room 140, smoothly.

By the way, the switching body 170 is biased with using a biasing body (for example, a torsion spring, a coil spring, etc.), to close the first release portion 143, always. And, when the mode of crushing the ice pieces is selected, then the switching body 170 is pulled up against the biasing body with using an actuator, and thereby opening the first release portion 143.

However, the stirrer 120 and the ice crusher unit 130 are provided as an ice processor unit, being assembled as a unit. Such unit is attached onto the main body member 300 of the ice supplying assembly 100 in one body.

Next, explanation will be made on the driver unit 190. The driver unit 190 is made up with a driver motor 191 and a gear 192. Also, within the driver unit 190 is provided an abnormal current detector unit (not shown in the figure) for detecting abnormal current, which can flow into the driver motor 191, as a detector means for detecting that there occurs an abnormality within the stirrer 120 and the ice crusher unit 130, such as, blockage of the ice pieces, etc.

By the way, as was mentioned above, the ice supplying assembly 100 can be separated into the base member 200 and the main body member 300, and on the main body member 300 are equipped with the stirrer 120 and the ice crusher unit 130, on the other hand, on the base member 200 are equipped with the driver unit 190 and the hopper unit 180. For this reason, the stirrer 120 and the ice crusher unit 130 must to be combinable and detachable (i.e., removable) with/from the driver unit 190, easily. The structure for enabling this will be explained hereinafter.

As shown in FIGS. 6, and 7 and 5, within the driver unit 190 is provided a transmitter unit 193 for transmitting a driving force to a connecting portion with the shaft member 310, to which the stirring members 121 and the movable edges 152 are attached. In more details, the transmitter unit 193 is provided at an upper end of a drive shaft 194 directly connected with the gear 192. On the other hand, on the shaft member 310, onto which the stirring members 121 and the movable edges 152 are attached, is provided a receiver (or, transmittee) unit 311, to which the driving force is transmitted, at the connecting portion with the drive shaft 194 of the driver unit 190. In more details, the receiver unit 311 is provided at a lower end of the shaft member 310.

The transmitter unit 193 has transmitting bosses 195 extending towards the receiver unit 311; and those transmitting bosses 195 rotate on an outer periphery of that rotation shaft, centering round the rotation axis of the drive shaft 194. The transmitting bosses 195 are provided in plural numbers thereof on the same circumference of a circle, centering round the rotation axis of the drive shaft 194, and in more details, they are provided in a pair at symmetric positions, centering round the rotation axis of the drive shaft 194.

On the other hand, the receiver unit 311 has a receiver body 312 for receiving the transmitting bosses 195, and that receiver body 312 rotates around the rotation axis of the shaft member 310. And, under the condition that the transmitter unit 193 and the receiver unit 311 are connected, when the transmitting bosses 195 rotates, then the receiver body 312 rotates in a mode of being pushed by it. In more details, the receiver unit 311 has a ring-like portion 313 being able to receive the transmitting bosses 195 of the transmitter unit 193 in an inside thereof, and the receiver body 312 is formed to extend from the inner periphery surface thereof directing to an inside, in the radial direction. In more details, the receiver unit 311 has a container shape, and is disposed in the condition of directing an opening 314 thereof below. Also, the receiver bodies 312 are provided in plural numbers thereof on the same circumference of a circle, centering round the rotation axis of the shaft member 310, and in more details they are provided in a pair at symmetric positions, centering round the rotation axis of the shaft member 310.

Also, the rotation axis of the drive shaft 194 and the rotation axis of the shaft member 310 are aligned to be on a same straight line, under the condition that the transmitter unit 193 and the receiver unit 311 are connected with. And, the rotation shafts of those drive shaft 194 and shaft member 310 are set to incline with respect to the horizontal direction. On the other hand, as was mentioned above, the removing direction between the main body member 300 and the base member 200 lies in the vertical direction. Accordingly, for the purpose of achieving smooth removal between the main body member 300 and the base member 200, the transmitting bosses 195 and the ring-like portion 313 are in such a relationship of sizes thereof, not to interfere with each other. And, when such the transmitting bosses 195 and the receiver unit 311 are connected with, then as is shown in FIG. 6, tip portions of the transmitting bosses 195 are in the condition that they enters into the ring-like portion 313.

In more details, with the pair of transmitting bosses 195, they are determined in such sizes that, the sizes of the projection area obtained by projecting the tip portion, which enters into an inside of the ring-like portion 313, onto a plane (i.e., a horizontal plane) perpendicular to the dividing direction mentioned above lie within the projection area obtained by projecting the opening 314 onto the plane mentioned above (i.e., the horizontal plane).

Next, explanation will be made on the operation of the ice supplying assembly 100 having such the structures as was mentioned above. However, in the ice supplying assembly 100, normally, the switching body 170 of the ice crusher unit 130 is in the advancing condition of advancing to the position for closing the first release portion 143 of the ice crusher room 140. Also, normally, the movable edges 152 are stopped at the position shifted from the projection area of the ice release unit 142 (or, the ice discharger portion 112), so that they do not block the ice release unit 142 (or, the ice discharger portion 112).

First of all, explanation will be made on the case when supplying the ice pieces, which are not crushed.

When a user operates the operator unit 12, the switching body 170 of the ice crusher unit 130 is in the retracting condition that it does not close the first release portion 143 of the ice crusher room 140 (i.e., the condition of opening the first release portion 143). Then, in case where the ice piece remains in the ice crusher room 140 since they are blocked by the switching body 170, those ice piece falls down towards the service place or space accompanying with the gravity thereof. Also, the stirring members 121 rotate within the ice storage unit 110, thereby stirring the ice pieces stored therein. Accompanying with this operation, the ice pieces stored within the ice storage unit 110 are discharged from the ice discharger portion 112 into the ice crusher room 140. Then, those ice pieces are directly discharged from the first release portion 143 without staying in the ice crusher room 140, since the switching body 170 retracts.

Next, explanation will be made on case when supplying the ice pieces, which are crashed.

When the user operates the operator unit 12, the switching body 170 of the ice crusher unit 130 is maintained in the advancing condition of advancing to the position for closing the first release portion 143 of the ice crusher room 140. Also, the movable edges 152 are driven to rotate, and then the ice pieces staying or stacking within the ice crusher room 140, being blocked by the switching body 170, are transferred towards the fixed edges 151, while being combed or scraped up to the above, obliquely, by the movable edges 152 within the ice crusher room 140.

Thereafter, the ice pieces are crushed, being put between the movable edges 152 and the fixed edges 151, and are discharged from the second release portion 144 of the ice crusher room 140. Further, the stirring members 121 rotate within the ice storage unit 110, in the similar manner to the case when the ice pieces are not crushed, and thereby stirring the ice pieces stored therein.

In addition thereto, explanation will be made on the control in case when an abnormality occurs, such as, the blockage of the ice pieces within the ice crusher room 140 or the like, for example. First of all, in case when the abnormality occurs, such as, the blockage of the ice pieces or the like, for example, and when the movable edges 152 are in the condition of being unable to rotate (i.e., in so-called the locking condition of the driver motor 123), the abnormal current detector unit detects the abnormal current flowing through the motor, and a signal of alarming that abnormality is sent to the controller unit (not shown in the figure).

Then, the controller unit controls the driver unit 190 to execute a recovery operation. As the recovery operation, the control is executed so as to rotate the movable edges 152 in the reversed direction, while stopping the operation of the driver motor 191. In this instance, the movable edges 152 are so controlled that they rotate around a predetermined angle (for example, 90 degrees) in the reversed direction, and thereafter, it turns back to a normal control, i.e., rotating into the forward direction, again. However, in case when the abnormal current detector unit detects that abnormal current, again (i.e., in case where the abnormality, such as the blockage of the ice pieces, etc., is still not dissolved), then the control is executed to rotate the movable edges 152 in the reversed direction, again.

However, if the abnormality is not dissolved in spite of several times of executions of the recovery operation mentioned above, the control is done to stop the operation of the driver motor 191, and alarms that it is inoperable to the user, through a lamp, etc., which is provided on the display unit 13 of the dispenser unit 10.

As was mentioned above, with the refrigerator and the ice supplying assembly 100 according to the present embodiment, since the ice pieces to be stored therein are collected into the shrinking portion 111, therefore it is possible to discharge them, preferably, from the ice discharger portion 112, which is disposed at that shrinking portion 111. Accordingly, it is possible to utilize the ice pieces stored, effectively, within the ice storage unit 110, without remaining therein.

Also, the shrinking portion 111 mentioned above is made up by the oblique surface 113, which is obtained by inclining an interior surface defining the ice storage unit 110 with respect to the horizontal direction. Accordingly, it is possible to collect the ice pieces below along the oblique surface 113, smoothly, thereby discharging them from the ice discharger portion 112.

Also, on the oblique surface 113 mentioned above is provided a guide portion 117 for guiding the ice pieces into the ice discharger portion 112, directing to that ice discharger portion 112, and that guide portion 117 is formed to be hollowed in a concave-like. Accordingly, it is possible to guide the ice pieces up to the ice discharger portion 112, with certainty.

Also, on the oblique surface 113 mentioned above is constructed with two (2) pieces of the crossing surfaces 114 and 115, crossing with each other, and on the one crossing surface 114 of those two (2) pieces of the crossing surfaces 114 and 115 is provided the ice discharger portion 112 mentioned above, while on the other crossing surface 115 is provided the guide portion 117 mentioned above. In this manner, separating those two (2) pieces of the crossing surfaces 114 and 115 in the function thereof, it is possible to control movement or behavior of the ice pieces, and thereby to discharge the ice pieces smoothly, much more.

Also, there are equipped with the stirrer 120 for stirring the ice pieces stored within the ice storage unit 110 mentioned above. Accordingly, it is possible to cause a disturbance to the ice pieces stored within the ice storage unit 110 mentioned above, and to collect the ice pieces below along the oblique surface 113, smoothly, much more, and thereby discharging them from the ice discharger portion 112.

Also, the stirrer 120 mentioned above has the stirring members 121, which are disposed to be rotatable within the ice storage unit 110. And, the ice storage unit 110 mentioned above is so constructed that, the gap defined between the interior surface thereof and the rotation area, which is defined by rotating the stirring members 121, differs from depending upon the angular position of that stirring members 121. Accordingly, it is possible to collide or bump the ice pieces on the interior surface of the ice storage unit 110, irregularly; therefore it is possible to cause the disturbance to the ice pieces, with certainty. Also, even if a plural number of the ice pieces melt and stick into a large block of ice, but with applying a shock or an external force accompanying the bumping, it is possible to dissolve them into each ice piece.

Also, the ice supplying assembly 100 has the ice crusher unit 130, which can crush the ice pieces discharged from the ice discharger portion 112 mentioned above, and the ice crusher unit 130 mentioned above has the switching body 170 for exchanged between the one path P1 for servicing the ice pieces without crushing and the other path P2 for servicing them with crushing. Accordingly, by means of the switching body 170 mentioned above, it is possible to switch over the servicing modes, easily. Also, the servicing modes can be changed by only switching over the disposition mode of the switching body 170.

Also, the ice crusher unit 130 mentioned above has the ice crushing member 150 for crushing the ice pieces, and that ice crushing member 150 is constructed with the movable edges 152, which rotate within the ice crusher room 140 and the fixed edges 151, and wherein, when the switching body 170 is in the condition of closing the one (or the first) release portion 143, the movable edges 152 rotate while moving the ice pieces thrown into the ice crusher room 140, thereby crushing by putting them between the fixed edges 151, and the crushed ices are discharged into an outside from the other (or the second) release portion 144, between the two (2) sets of the release portions 143 and 144.

Also, the movable edges 152 has the raking portion 153 for raking out the ice pieces pliable, which can accumulate on the bottom surface 147 of the ice crusher room 140. Accordingly, ever time when the movable edges 152 rotate, it is possible to rake or scrape out the pliable ice pieces, and therefore it is possible to protect the ice crusher unit 130 from the mal function occurring due to the reason of the pileup of the ice pieces.

Also, the ice crusher unit 130 is constructed so as to crush the ice pieces by rotating the movable edges 152 mentioned above only into a predetermined direction, and in case when the movable edges 152 come to be unable to rotate, after once rotating them in the reversed direction, they are operated to rotate in the forward direction, again. As the cases where the movable edges 152 are unable to rotate, there can be considered a case when an abnormality occurs, such as, the blockage of ices, etc.; however in such cases, it is possible to prevent the movable edges 152 and/or the driver unit 190 for driving those movable edges 152 from being damaged, and thereby obtaining a protection of the ice crusher unit 130, and the ice supplying assembly 100 in its turn.

Also, within the ice supplying assembly 100 are disposed the stirrer 120 and the ice crusher unit 130 mentioned above, in such a manner that they are disposed within the projection area in the horizontal direction of the oblique surface 113 mentioned above. Accordingly, it is possible to achieve small-sizing of the ice supplying assembly 100, and further easy handling of the ice supplying assembly 100.

However, the refrigerator and the ice supplying assembly according to the present invention should not be restricted to the structures mentioned above, but may be modified variously, but within a breadth not deviating from the gist of the present invention.

For example, in the embodiment mentioned above, the explanation was given that the ice discharger portion 112 is provided on the one crossing surface 114 between the two (2) pieces of crossing surfaces 114 and 115 building up the oblique surface 113; however, according to the present invention, it should not be limited to this, but ice discharger portion 112 may be provided to bridge over both of those two (2) pieces of crossing surfaces 114 and 115. As such may be considered such a one, i.e., the ice discharger portion is provided at a valley portion, which is defined by crossing those two (2) pieces of the crossing surfaces 114 and 115.

Also, the stirrer 120 mentioned above was explained to have the stirring members 121, which are disposed to be rotatable within the ice storage unit 110; however they should not be limited to this, those stirring members 121 may operate in any kind of behavior, as far as they are able to stir or agitate the ice pieces. Further, if possible to cause the disturbance to the ice pieces, they may be ones giving vibration thereto, for example.

Also, the ice crusher unit 130 mentioned above was explained that the passage P thereof can be switched over between two (2) modes by the switching body 170; however it should not be limited to this, but on the same passage, it may be a one for switching over between the process of crushing the ice pieces or not, on the way thereof. In this case, the discharging portion may be provided by only one (1).

Also, the ice crushing member 150 mentioned above was explained to be built up with the movable edges 152 rotating within the ice crusher room 140 and the fixed edges 151; however they should not limited to this, both those edges may be rotatable. Further, the configuration and the operation of that crushing member may be any ones, as far as it can crush the ice pieces.

Also, on the upper surface 146 of the ice crusher room 140 was explained to build up a part of the one crossing surface 114; however it should not be limited to this. Also, from the relationship that the upper surface 146 of the ice crusher room 140 builds up the part of the one crossing surface 114, the input portion 141 of the ice crusher room 140 corresponds to the ice discharger unit 112 of the ice storage unit 110; however it should not be limited to this, the ice crusher room and the ice storage unit may be provided at the positions separated from each other, and they may be connected through a passage for the ice pieces, which is provided dividing from the input portion and the ice discharger unit.

Also, the ice supplying assembly 100 and the water supplying assembly are explained to be operated by pushing the lever, which is provided in the service space 11, but it should not be limited to this. For example, the driver unit 190 may be driven by operating the operator unit 12 of the dispenser unit 10. As a mode of driving thereof, it may continues the driving during only a time-period when the user operates the operator unit 12 (for example, when she/he pushes down the button), or may be stopped after driving of a predetermined time-period (for example, 5 to 10 seconds) when the operator unit 12 is operated once.

Also, the ice maker assembly 22 was explained to be provided on the freezer room 20; however it should not limited to this, but it may be provided on a side of the freezer room door 21. In this instance, there can be considered such structures that the ice maker assembly is provided just above the ice supplying assembly 100, for example.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications that fall within the ambit of the appended claims.

What is claimed is:

1. An ice supplying apparatus, being provided in a refrigerator, comprising:

an ice maker unit, which is configured to supply ice pieces produced therein to an outside of a freezer room door;

an ice storage unit, which is configured to store the ice pieces produced by said ice maker unit;

an ice discharger unit, which is provided within said ice storage unit to discharge the ice pieces below;

a shrinking portion, which is provided in said ice storage unit and defines an interior space thereof as small as it goes down, through building up a lower surface, among interior surfaces defining that interior space of said ice storage unit, for supporting the ice pieces stored therein from a lower portion thereof, by a surface inclining to a horizontal direction, wherein said ice discharger unit is disposed in a lower portion of said shrinking portion;

a stirrer, which is configured to stir the ice pieces stored within said ice storage unit, wherein said stirrer comprises a stirring body to be disposed within said ice storage unit, and said stirring body is provided to be rotate around a rotation shaft, which is inclined to the horizontal direction; and an ice crusher unit, which is able to crush the ice pieces discharged from said ice discharger unit, wherein said ice crusher unit has a switching body, which is configured to switch a passage for the ice pieces between one path for supplying the ice pieces without crushing and other path for supplying the ice pieces with crushing.

2. The ice supplying apparatus, as described in the claim 1, wherein on said lower surface is provided a guide portion, for guiding the ice pieces to said ice discharger unit, directing to said ice discharger unit, and said guide portion is formed to be hollowed in a concave manner.

3. The ice supplying apparatus, as described in the claim 2, wherein said lower surface is made up with two (2) pieces of crossing surfaces, crossing with each other, on one of said two (2) pieces of crossing surfaces is provided said ice discharger unit, and on the other crossing surface is provided said guide portion.

4. The ice supplying apparatus, as described in the claim 1, wherein said ice crusher unit further comprises an ice crusher room, which is configured to crush the ice pieces therein, said ice crusher unit has an input unit, to which the ice pieces discharged from said ice discharger unit are thrown in, and a discharger unit, which is configured to discharge the ice pieces inputted into an outside, and said discharger unit is built up with two (2) pieces of discharging portions, which are provided corresponding to said two (2) pieces of paths, wherein one discharging portion of said two (2) pieces of discharging portions is provided to communicate with said input unit in a vertical direction, and said switching body is constructed to be switched into a condition of closing said one discharging portion and a condition of not closing it.

5. The ice supplying apparatus, as described in the claim 4, wherein said crusher unit for crushing the ice pieces is made up with movable edges rotating within said ice crusher room and fixed edges, said movable edges rotate while shifting the ice pieces thrown into said ice crusher room, so as to put them between said fixed edges, and thereby crushing them, when said switching body is in the condition of closing said one discharging portion, and the ice pieces crushed are discharged into the outside from the other discharging portion between said two (2) pieces of discharging portions.

6. The ice supplying apparatus, as described in the claim 1, wherein said movable edges are provided to be rotatable around the rotation shaft inclining with respect to the horizontal direction.

7. The ice supplying apparatus, as described in the claim 5, wherein said movable edges have scraping portion to scrape out the ice pieces which can accumulate on a bottom surface of said ice crusher room.

8. The ice supplying apparatus, as described in the claim 1, wherein said stirrer and said movable edges are provided on a same shaft member.

9. The ice supplying apparatus, as described in the claim 5, wherein said ice crusher unit is constructed to crush the ice pieces while rotating said movable edges only one direction, and said movable edges are operated to rotate in a forward direction, again, after rotating in a reversed direction once, when said movable edges come to be unable to rotate.

10. The ice supplying apparatus, as described in the claim 1, wherein said stirrer unit and said ice crusher unit are disposed to be received within a projection area of said lower surface in the horizontal direction.

11. A refrigerator, comprising the ice supplying apparatus, as described in the claim 1.

* * * * *